United States Patent [19]

Willenbacher

[11] Patent Number: 4,546,712

[45] Date of Patent: Oct. 15, 1985

[54] SEWING MACHINE HAVING THE NEEDLE HOLDER MAGAZINE WITH AUTOMATIC COUPLING AND DECOUPLING OF THREAD CONTAINING NEEDLES AND NEEDLE HOLDERS

[75] Inventor: Erich Willenbacher, Kaiserslautern, Fed. Rep. of Germany

[73] Assignee: Pfaff Industriemaschinen GmbH, Fed. Rep. of Germany

[21] Appl. No.: 589,493

[22] Filed: Mar. 14, 1984

[30] Foreign Application Priority Data

Mar. 17, 1983 [DE] Fed. Rep. of Germany ..... 3309509

[51] Int. Cl.[4] ..... D05B 55/16; D05C 11/06

[52] U.S. Cl. ..... 112/89; 112/221; 112/241; 112/274

[58] Field of Search ..... 112/221, 98, 83, 84, 112/79 R, 79 A

[56] References Cited

U.S. PATENT DOCUMENTS

| | | | |
|---|---|---|---|
| 2,832,301 | 4/1958 | Woar | 112/221 X |
| 3,075,481 | 1/1963 | Stratton | 112/221 X |
| 4,075,958 | 2/1978 | Sacchetti | 112/221 X |
| 4,276,838 | 7/1981 | Bolldorf | 112/221 |
| 4,301,756 | 11/1981 | Teetz et al. | 112/221 |

*Primary Examiner*—H. Hampton Hunter

*Attorney, Agent, or Firm*—McGlew and Tuttle

[57] ABSTRACT

A thread changing mechanism for sewing machines includes a magazine in which a plurality of needle holders is received, to be positively coupled to the sewing machine needle bar by a vertical motion of the magazine. Upon effecting a coupling, the magazine is retracted into a starting position remote from the needle bar, so that the needle bar with the needle holder can unobstructedly move during the sewing operation. The thread changing mechanism is mounted on a sewing machine as an attachment later, without particular adjustments. When the needle holders are held in the magazine the thread is engaged with each needle and held out of the way of the operating needle thread.

16 Claims, 5 Drawing Figures

1
2
3
4
5
6
11
28
29
30
31
32
33
34
35
37
39
40
46
47
48
49
51
52
53
54
55
56
57
58
59
60
61
62
63
64
65
66
67
68
69
70
71
73
74
77
82
83
84
101
102
104
108
111
113
114
115
II

SEWING MACHINE HAVING THE NEEDLE HOLDER MAGAZINE WITH AUTOMATIC COUPLING AND DECOUPLING OF THREAD CONTAINING NEEDLES AND NEEDLE HOLDERS

FIELD AND BACKGROUND OF THE INVENTION

This invention relates in general to sewing machines and in particular to a new and useful sewing machine having a magazine containing a plurality of separate thread supply needles in needle holders which may be selectively coupled and decoupled to a needle bar.

A thread changing mechanism is disclosed in the German OS No. 29 27 142. This mechanism, intended for small embroidering machines having a plurality of needle bars, provides for each needle bar a magazine which is displaceable in its longitudinal direction, transversely to the longitudinal axis of the needle bar. The magazine accommodates a plurality of needle holders, each carrying a needle, with only one of these holders of the magazine being operable to the needle bar at a time. To change the thread, the embroidering machine must be stopped and the needle bar is lifted above its upper dead center position, whereby the needle holder just connected to the needle bar is retracted into its magazine and thereby uncoupled from the needle bar. As soon as needle bar at the end of this lifting motion has entirely been withdrawn from the magazine, the magazine is displaced and the next needle holder needed for the embroidering operation is brought into a standby position. The needle bar is then lowered again whereby it is coupled to the new needle holder.

Since the regular working stroke of the needle bar is extended by the additional lifting, the total height of displacement is relatively very large and requires correspondingly spaced apart bearings. Further, since another drive, different from the normal one for the working stroke, is needed for the additional lifting of the needle bar, the supporting structure of the needle drive enlarges to dimensions which call for an accommodating housing correspondingly voluminous. This does not raise problems in a development of an embroidering machine, where the size of the housing can easily be adapted. Great difficulties would be encountered however, with an attempt to proceed similarly in connection with a conventional sewing machine.

SUMMARY OF THE INVENTION

The invention is directed to a thread changing mechanism occupying such a small space that it can be used not only in embroidering machines, but also in conventional sewing machines.

By providing that the needle holder is coupled to, or uncoupled from, the needle bar by vertically moving the magazine in which the needle holders are received and that then the magazine is moved from its transfer position laterally into a rest position, the thread changing mechanism can be used particularly also for sewing machines having normally driven needle bars, in being sure that the magazine will not hinder the motion of the needle holder coupled to the needle bar.

The invention includes an arrangement for effecting a positive and thus accurate and safe connection between the needle holder and the needle bar.

In accordance with the invention, the sewing machine includes a reciprocating needle bar which cooperates with a rotary hook and includes a mechanism for stopping the needle bar in a selected position for example a top dead center position and for moving a magazine into association with the needle bar to remove the previous needle holder and its associated thread, and to position a new holder with its associated thread into coupled engagement with the needle bar and which will be operated therewith while the remaining threads are maintained out of operative positions. The magazine is advantageously supported on a slide which moves along a line which is parallel to the reciprocation plane of the needle bar so as to position a selective needle holder in alignment with the bar. The holder is shifted into engagement with the bar by a mechanism which moves the magazine to a position in which the holder becomes engaged with a coupling which automatically positions it in respect to the needle bar for reciprocation therewith. A replacement needle holder is advantageously inserted with the needle in the top dead center position which is determined by movement of a locking lever into engagement with a notch on a locking wheel. The magazine itself includes a support and holding plate which has an edge with a plurality of notches of a number comparable to the number of needle holders which are to be engaged therein. The plate is movable with the needle holders after a selected needle holder is aligned with the needle bar. Coupling of the needle holder with the needle bar is effected by directing a pin-like extension of the needle bar into the hollow needle holder while engaging a locking sleeve associated with the needle bar so as to move it against a biasing force and cause a ball locking coupling to move to a position in which balls retained in radial recesses thereof engage in a locking groove formed on the pin of the needle bar.

With the exception of providing a circular groove at the end of the needle bar, the design and operation of magazines do not require any further adaptation or change in an embroidering or sewing machine. In consequence, the inventive mechanism is particularly suitable also for being mounted on a sewing machine subsequently, or sewing mechanism provided for other purposes may inexpensively be equipped with the inventive mechanism.

The needle holders are advantageously made hollow and include a receiving bore and a spring loaded locking bolt which is biased upwardly and compressed when coupling is effected. During uncoupling the bolt moves upwardly and causes balls which are positioned in a locking groove of the needle bar to move outwardly into a receiving groove defined in a locking sleeve which surrounds the hollow holder. The sleeve is urged by a compression spring upwardly against a retaining holder but may be moved downwardly by engagement of a obtaining ring of the sleeve in a groove of the holding plate of the needle holder magazine.

The arrangement secures a position of the balls upon uncoupling a needle holder, so that they cannot fall out of the cross bores. During the coupling of the needle holder, as soon as the locking bolt is pushed back, by butting against the needle bar end, the carrier and the locking sleeve are further retained by the pressure lever resiliently applying against the lower end of the carrier, in connection with the magazine recess receiving the locking sleeve, in the position holding the balls in the uncoupling position, so that the needle holder can be fully engaged on the needle bar end. Then, the spring biased locking sleeve is released by moving the magazine horizontally transversely from its transfer position into its rest position, and moves into the coupling or locking position in which the locking extension urges the balls into the circular groove of the needle bar. It is advantageous in this connection to provide the presser levers in a length ensuring that they leave the zone of the carrier only after the locking sleeve has reached its coupling or locking position.

Spring loaded clamping levers prevent the needle holders received in the magazine from falling out and clamp the thread extending from the needle of the respective needle holder to the thread supply, between the locking sleeve and the wall of the recess in the magazine. In this way, the threads which do not participate in the stitch formation are prevented from unthreading.

Catching levers hold the portions of the non-participating threads, extending between the conventional thread tensioning device and the clamping locations, in a biased position so that the respective thread guide fingers of the take-up lever can move therealong without pushing them up or off. In this way, the threads not participating in the stitch formations are prevented from tangling individually or with each other.

A stop plate, movable along with the magazine in the longitudinal direction thereof is a particularly simple device for controlling the thread catching levers, requiring no drive.

The needle bar, which has been stopped by a needle positioning device known per se, in its upper dead center position within a tolerance zone of a few degrees of angle, can be moved into the dead center position exactly, so that the coupling and uncoupling of the needle holder can be effected safely and accurately. At the same time, the mechanism is secured against unintentional rotation of the arm shaft, whereby other casual damages to the thread changing mechanism and/or the needle bar are avoided.

Accordingly it is an object of the invention to provide an improved sewing machine which has a magazine for a plurality of needle holders with needles which are separately connected to a thread supply and wherein the magazine may be moved relative to a reciprocating needle bar and positioned to engage the needle bar for removing a previously engaged needle holder, and subsequently move after realignment to a position in which a new needle holder is positioned therein which advantageously also includes means for engaging the thread of the needle holders which are retained in the magazine so that they do not interfere with the operation of the one which is permitted to be drawn up by the take-up lever of the operating machine.

A further object of the invention is to provide a drive for a sewing machine which has a magazine for exchanging needle holders which cooperate with a reciprocating needle bar and which includes a long shaft which drives the needle bar and a rotary hook drive shaft which drives the rotary hook cooperating with the needle and wherein the rotary hook shaft is provided with a locking wheel having a notch and which is arranged adjacent a locking lever which is pivotally mounted on the machine and which can be automatically operated to engage in the notch to stop the machine in a top stop dead center position for exchange of the needle holders.

A further object of the invention is to provide a needle thread guide mechanism which includes a stop plate which is mounted on a slide adjacent the needle bars and has a plurality of alternately arranged needle support sectors and slots defined along the top face thereof arranged alongside a guide finger for a thread supply for each needle, and including a thread catching lever for each needle of each needle holder pivotally mounted on the arm of the sewing machine adjacent the stop plate and the guide finger. The catching levers are each engageable in an operative position on a respective one of the sectors and with the thread sets of each needle from each thread supply and being engageable in an nonoperative position in a respective slot portion in which it lies out of the path of movement of its associated needle thread.

A further object of the invention is to provide a coupling mechanism for effecting the quick coupling decoupling of a needle holder to a reciprocating needle bar.

A further object of the invention is to provide a sewing machine having improved thread changing elements which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 4:
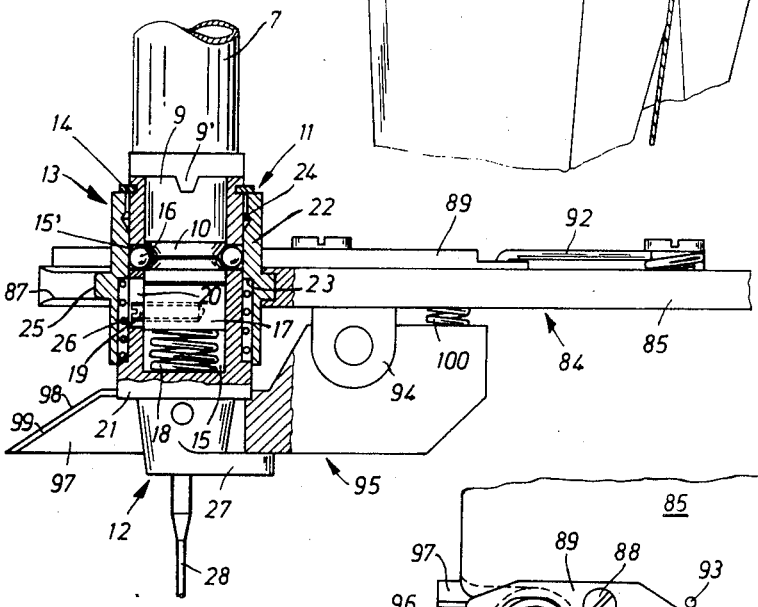
FIG. 4 is a partly sectional view of a needle holder received in the magazine.
Figure 5:
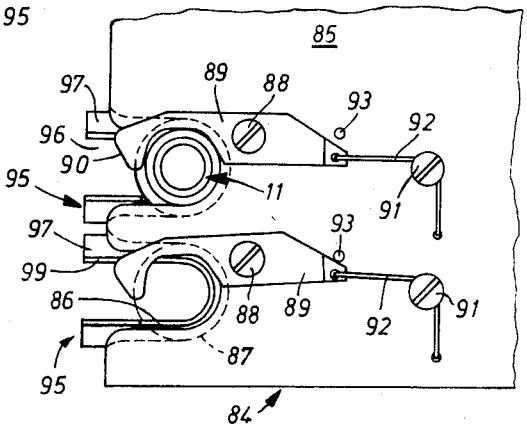
FIG. 5 is a partial top plan view of the magazine.

Referring to the drawings, in particular the invention embodied therein comprises a sewing machine generally designated 1 which comprises a reciprocating needle bar 7 shown in FIG. 4 which is arranged alongside a slide 58 which is mounted for backward and forward movement adjacent the needle bar. A magazine 84 for a plurality of needle holders 11 is carried by the slide and it is also connected to means for shifting it vertically 77 carried by the slide 58 connected to the magazine 84. The magazine 84 has a holding plate 85 as shown in FIG. 5 with a recess or opening 86 for each needle holder arranged in a row along one side of the plate 85 and extending the direction of movement of the slide. The slide is moved selectively by slide moving means 59 in the form of multiposition cylinders so as to position a selected needle holder 11 in alignment with the needle bar 7. A cross slide 80 is mounted on the slide 58 for movement toward and away from the needle bar 7 for the purpose of advancing a selected needle holder either into or out of engagement with the needle bar 7.

The sewing machine has a housing 1 comprising a base plate 2, a post 3, and an arm 4 terminating with a head 5. A hollow needle bar 7 mounted in head 5 is driven in a manner known per se (not shown) by an arm shaft 6 which is supported in arm 4. Also mounted in head 5 is a take-up lever 8 forming a component part of a known take-up mechanism.

According to FIG. 4 a flanged pin 9 provided with a wedge-shaped nose 9′ and a circular groove 10 is secured in the hollow of needle bar 7. A needle holder 11 is engaged on pin 9, substantially comprising a carrier 12 and an axially displaceable locking sleeve 13 embracing the carrier. Carrier 12 is provided with a notch (not shown) cooperating with nose 9′ to secure needle holder 11 against rotation, and with a guard ring 14 limiting the movement of locking sleeve 13. Carrier 12 has an axial bore 15 in which pin 9 is received, and a priority of radial bores 15′ each displaceably accommodating the ball 16. In the lower portion of ball 15, a locking bolt 17 is received for displacement and loaded by a compression spring 18. A set screw 19 partly screwed into locking bolt 17 projects into a vertically extending slot 20 of carrier 12. Carrier 12 is designed with a stop shoulder 21.

Locking sleeve 13 has inside an inwardly projecting lock ring portion 22 which is limited on one side by a shoulder 23 and on the other side by a circular groove 24. Externally, locking sleeve 13 is provided with an outwardly projecting ring 25. A compression spring 26 received between carrier 12 and sleeve 13 and bearing against shoulder 23 and stop shoulder 21 urges locking sleeve 13 upwardly against guard ring 14. In this position, lock ring portion 22 pushes balls 16, which have a diameter exceeding the wall thickness of carrier 12 in this area, into circular groove 10 of pin 9, so that needle holder 11 is positively locked to needle bar 7.

Carrier 12 is designed with a mount 27 for a third guiding needle 28. Needle 28 cooperates with a rotary hook known per se (not shown) which is driven through a shaft 29 mounted below base plate 2. Shaft 29 is driven from arm shaft 6 through a gear belt 30.

On the right hand end of arm shaft 6, a pulse transmitter 31 known per se is provided which is effective in connection with a positioning motor (not shown) driving the sewing machine, to stop the sewing machine in the top dead center position of needle bar 7. A locking wheel 32 is secured to shaft 29, having a wedge-shaped notch 33. Wheel 32 is associated with a locking lever 35 which is pivotable by an air cylinder 34 and has an end portion conformable to notch 33.

Further mounted in head 5 is a presser bar 36 engaging a presser foot 37. Presser foot 37 is connected to an oscillating drive 38.

Figure 1:
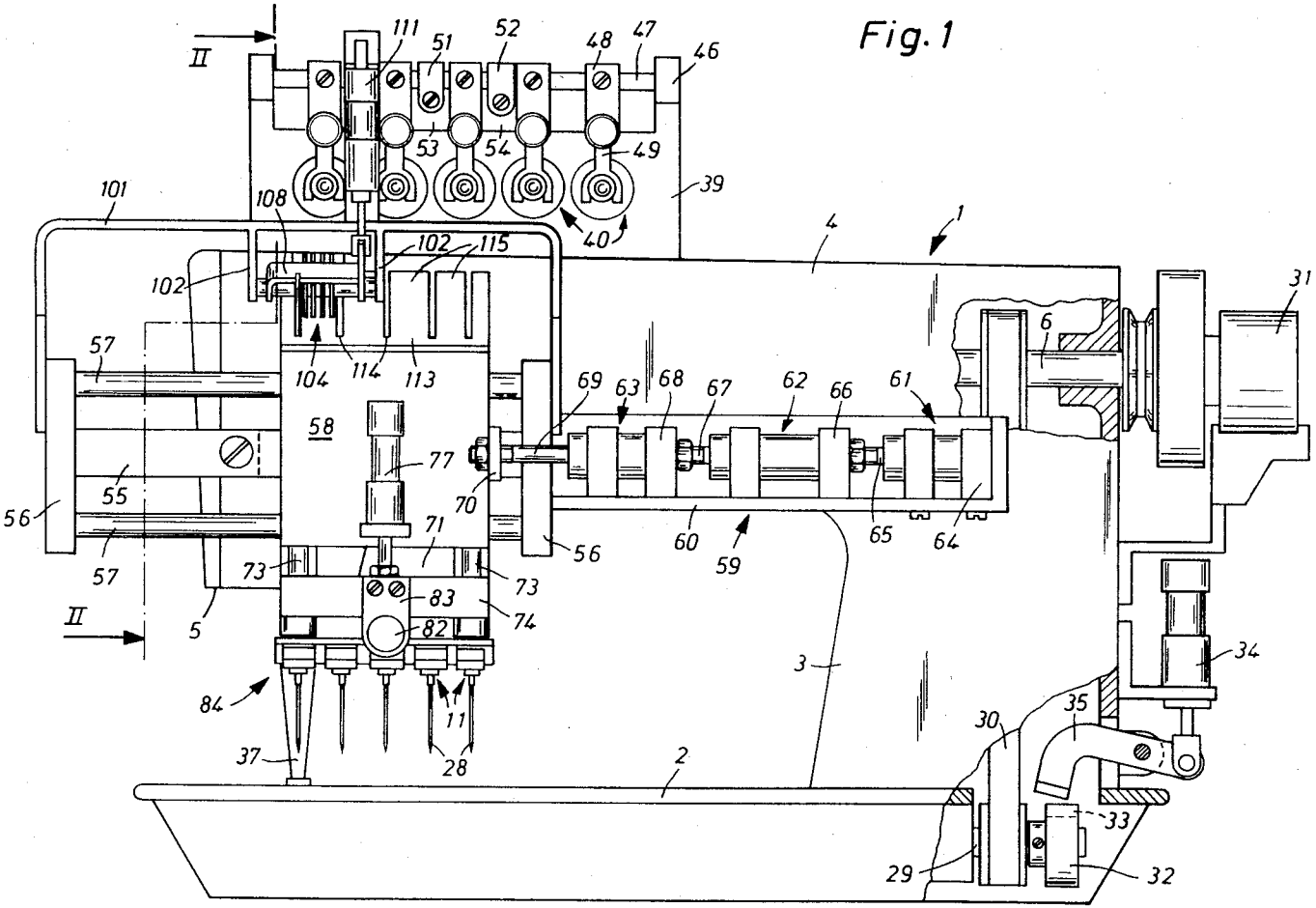
FIG. 1 is a side elevation of a sewing machine equipped with the thread changing mechanism.

Arm 4 supports a bracket 39 which is secured thereto and carries five thread tighteners 40. Thread tighteners 40 comprise each a threaded bolt 41 which is secured to the bracket 39 and carries two tension discs 42. The tension discs are pressed against each other by a compression spring 43. Compression spring 43 bears against a pressure disc 44 which is spaced apart from tension discs 42 by a distance determining the force of the spring 43 and variable by an adjusting nut 45. On two extensions 46 of bracket 39, a shaft 47 is mounted to which one support 48 for each of thread tighteners 40 is secured. A finger 49 is hinged to each of supports 48, and the angular position of the finger relative to support 48 is adjustable by a set screw 50. The free end of each finger 49 is forked and engaged between pressure disc 44 and adjusting nut 45 of the associated thread tightener 40. Secured to shaft 47 are further two levers 51, 52 of which one 51 is associated with a short-stroke cylinder 53 (FIGS. 1, 2) and the other lever 52 is associated with a short-stroke cylinder 54 (FIG. 1). The two short-stroke cylinders 53, 54 secured to bracket 39 have unequal pistons, so that the basic tension adjusted by means of adjusting nut 45 can be augmented in two steps.

A supporting plate 55 mounted on arm 4 and head 5 carries two side plates 56 which are secured thereto and support two horizontally extending, mutually parallel guide rods 57. A slide 58 is mounted for displacement on guide rods 57. Slide 58 is driven by a so called multi-position cylinder 59 comprising an angle bracket 60 secured to arm 4, and three individual air cylinders 61,62,63 aligned in series. The housing 64 of air cylinder 61 is secured to angle bracket 60 and the piston rod 65 thereof is connected to the housing 66 of air cylinder 62. Housing 66 is shiftable on angle bracket 60. The piston 67 of air cylinder 62 is secured to the housing 68 of air cylinder 63. Housing 68 is also shiftable on angle bracket 60. The piston rod 69 of air cylinder 63 is secured to an extension 70 of slide 58.

Air cylinder 61,63 have a stroke of 20 mm, air cylinder 62 has a stroke of 40 mm. By supplying the air cylinders individually, in groups, or all at the same time, slide 58 can be brought into five different positions, with the spacing of these positions being stepped by 20 mm.

Slide 58 is apertured at 71 and has two extensions 72 and carries two mutually parallel vertically extending guide rods 73 on which a U-shaped carrier plate 74 extending through aperture 71 is mounted for displacement. Carrier plate 74 is provided with a recess 75 which is opened toward head 5. Connected to carrier 74 is the piston rod 76 of an air cylinder 77 which is secured to an extension 78 of slide 58. Carrier plate 74 comprises two mutually parallel horizontally extending guide rods 79 on which a cross slide 80 is mounted for displacement. Cross slide 80 is connected to the piston rod 81 of an air cylinder 82 which is mounted on a plate 83 secured to carrier plate 74.

At the other side of cross slide 80, a magazine 84 for five needle holders 11 is mounted. Magazine 84 comprises a holding plate 85 which is secured to the cross slide 80 and is provided with five recesses 86 which are open toward needle bar 7 and are slightly wider than the diameter of locking sleeve 13. The center to center spacing of two adjacent recesses 86 is 20 mm. The side walls of recesses 86 are provided with a a groove 87 having the shape and size of retaining ring 25 of locking sleeves 13. On the top of holding plate 85, adjacent each of the recesses 86, a hook-shaped clamping lever 89 is pivoted by means of a flanged bolt 88. At the needle bar side, lever 89 has an oblique face 90. Each of clamping levers 89 is associated with a torsion spring 92 which is fixed to holding plate 85 by a flanged screw 91 and urges the respective arm of clamping lever 89 toward a stop pin 93 which is secured to plate 85.

On a lug 94 of holding plate 85, a presser lever 95 is mounted below each of recesses 86. Presser levers 95 threaded and provided with a recess 96, to form a fork 97. Recess 96 is slightly wider than the diameter of mount 27 of needle holder 11. At its end facing needle bar 7, fork 97 is beveled at 98 and thus wedge-shaped. Adjacent recess 96, fork 97 is provided with a shallow recess 99 having a width corresponding to the diameter of stop shoulder 21 of lever holder 11. Each of presser levers 95 is associated with a compression spring 100 effective to bias the fork 96 of presser lever 95 to pivot upwardly.

Secured to side plates 56 (FIG. 1) is a U-shaped frame 101 supporting two downwardly extended web plates 102. Web plates 102 support a bolt 103 carrying five thread catching levers 104 which are mounted thereon for free pivoting and are equidistantly spaced from each other. Each of thread catching levers 104 comprises a long catching arm 106 terminating with a hook 105, and a short switching arm 107. Pivoted to bolt 103 is further a U-shaped switching bracket 108 associated with switching arm 107. An arm 109 is secured to switching bracket 108, which is connected to the piston rod 110 of an air cylinder 111. Air cylinder 111 is mounted on frame 101 through an angled support 112.

Thread catching levers 104 are associated with a stop plate 113 which is secured to slide 58 and thus movable along therewith. Stop plate 113 has five vertically extending slits 114 having a width slightly exceeding that of catching lever 106. Slits 114 subdivide stop plate 113 into six sectors 115 of such widths that, depending on the instantaneous position of slide 58, always four thread catching levers 104 repose against a respective sector 115 and occupying the upper pivotal position shown in FIGS. 2 and 3. While only the thread catching lever 104 associated with the needle holder 11 which is coupled to needle bar 7 being engaged in one of slits 114 into which it dropped under its weight, and occupying the lower pivotal position shown in FIGS. 2 and 3.

The free end of take-up lever 8 is formed with five juxtaposed thread guiding fingers 116. The spacing between the fingers is about twice the width of a catching arm 106 of thread catching levers 104. Each thead guiding finger 106 is provided with a bore 117. Below take-up lever 8 five thread holding hooks 118 are mounte on the head 5.

The mechanism operates as follows:

According to FIG. 1, needle holder 11 at the left hand side is shown coupled with needle bar 7. The other four needle holders 11 are received in the respective recesses 86 of magazine 84 with retaining rings 25 being engaged in grooves 86. Presser lever 95 resiliently apply against stop shoulders 21. Locking bolts 17 are in their upper positions and press balls 16 into groove 24, whereby locking sleeve 13 is held fast in its uncoupled position and balls 16 are prevented from falling out of radial bores 15'. Clamping levers 89 which resiliently apply against locking sleeves 13 retain needle holders 11 firmly in recesses 86 and, at the same time, clamp the needle thread portions extending from needles 28 to take-up lever 8 between retaining rings 25 and the walls of recesses 86.

Figure 2:
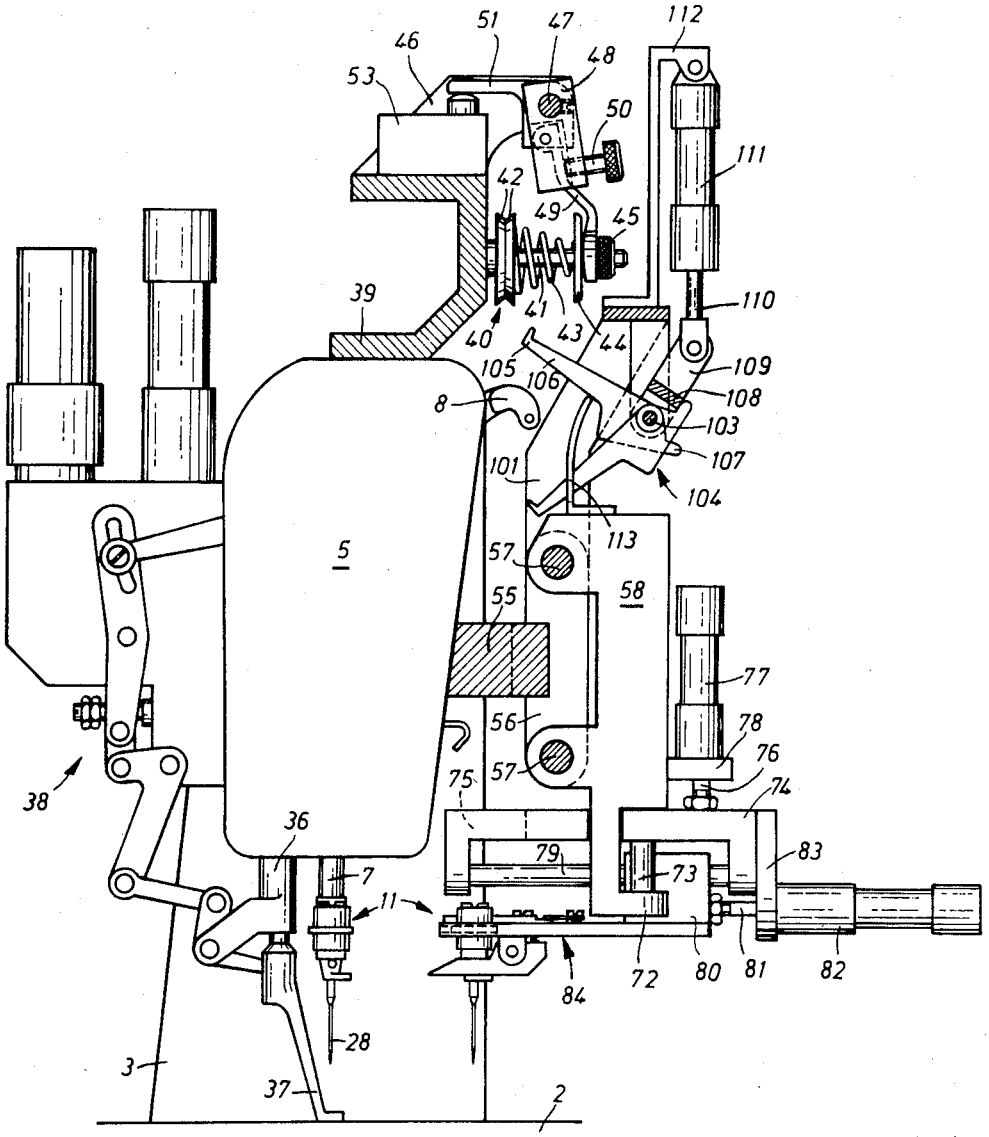
FIG. 2 is a sectional view taken along the line II—II of FIG. 1.
Figure 3:
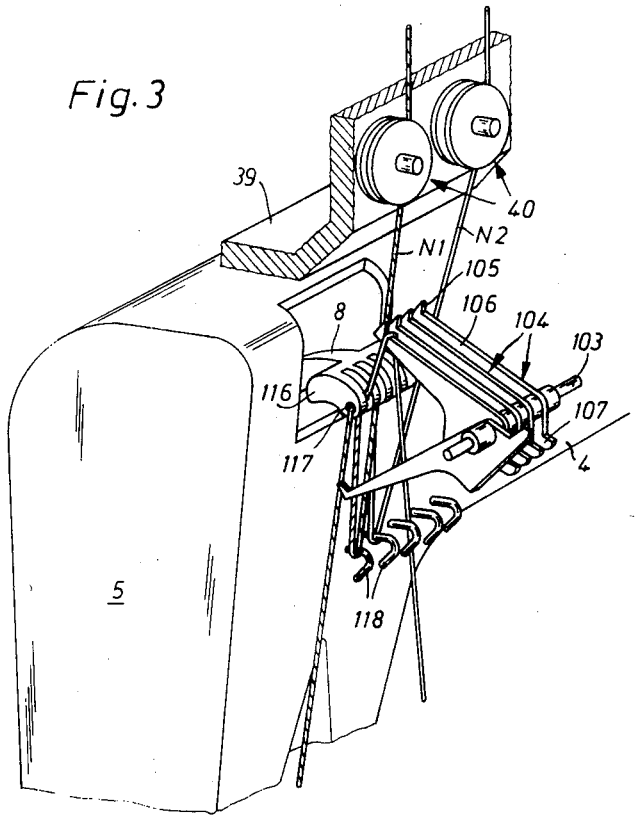
FIG. 3 is a perspective view of the take-up lever and the thread catching lever.

Slide 58 is held by multiposition cylinder 59 in its right hand end position, so that the left hand (FIG. 1) recess of magazine 84 associated with the coupled needle holder 11 opposes needle bar 7. Air cylinder 77 holds carrier plate 74 with cross slide 80 and magazine 84 in the lifted position shown in FIG. 2, in which the needle holders 11 received in the magazine 84 are vertically spaced above the base plate 2 by the same distance as the needle holder 11 which is coupled to the needle bar 7, when occupying its upper dead center position. At the same time, air cylinder 82 holds cross slide 80 and magazine 84 in the position remote from the needle bar 7 as shown in FIG. 2. The needle holder 11 coupled to needle bar 7 is positively connected to needle bar 7, since locking sleeve 13, which is held in its upper position by compression spring 26, presses the balls 16 through ring portion 22 into circular grooves 10 of flanged pin 9.

Needle thread N1 which leads to a thread supply (not shown), extends between the tension discs 42 of the thread tightener 40 (FIG. 1) at the left hand side (FIG. 1) is deflected upwardly by the associated hook 188, and extends through bore 117 of the thread guiding pin 116 at the left (FIG. 3), and is threaded in the needle 28 of the needle holder 11 which is coupled to the needle bar 7. The left (FIG. 3) thread catching lever 103 is engaged in the associated left hand slit 114 of stop plate 113, so that hook 105 comes into a position below the path of motion of the thread guide finger 116 of take-up lever 8, and, consequently, does not produce any retaining effect on the needle thread portion N1 which is moved up and down by take-up lever 8 during the sewing operation.

Needle thread N2 which leads to a second thread supply, extends through the other thread tightener 40 (FIG. 3) to the associated hook 118 and thereupon through bore 117 of the other thread guiding finger 116 to the needle of the second needle holder 11 which is received in magazine 84. The needle thread N2 is clamped between needle holder 11 and magazine 84 in the way described above. The second to fifth thread catching lever 104 reposed on the other sectors 115 of stop plate 113 and occupy the upper pivotal position shown in FIG. 3. In this pivotal position, hooks 105 are in a position laterally adjacent the path of motion of the associated thread catching fingers 116, thus in the path of motion of the needle thread portions moved up and down by take-up lever 8. In this way, needle thread N2 (shown in FIG. 3 and representing also all the other needle threads which are not shown) is caught by the hook 105 of the second thread catching needle 104, whereupon the thread guiding finger 116 of take-up lever 8 moves alongside the portion of needle thread N2 which is stretched between the clamping location in magazine 84 and hook 105 without taking it up or pushing it away. Thread catching levers 104 thus engage the needle threads which lead to the needle holders 11 received in magazine 84 and prevent them from participating in the sewing operation and from being tangled by take-up lever 8 in themselves, or with the other ones.

To exchange a needle holder 11, the sewing machine is stopped in the upper dead center position of needle bar 7, through pulse generator 31. Then, through air cylinder 24, locking lever 35 is pivoted to notch 33 of locking wheel 32, to readjust the stop position of needle bar 7, if necessary in view of the tolerance field of pulse generator 31. By pivoting the locking lever 35 into the notch 33 of the wheel 32, the sewing machine is also secured against an unintentional turning of arm shaft 6.

As soon as needle bar 7 is stopped exactly in its upper dead center position, magazine 84 is moved by air cylinder 82 toward needle bar 7. At the end of this motion, the needle holder 11 coupled to needle bar 7 comes within recess 86. Then, magazine 84 is moved by air cylinder 77 downwardly, whereby locking sleeve 13 is pushed against the action of cooperation spring 26 from its coupled position into it uncoupling position. At the same time, ring portion 22 is moved away from ball 16 and instead, groove 24 is brought into the range of balls 16, whereupon the balls are pushed by the further working motion of magazine 84 from circular groove 10 into groove 24, and needle holder 11 is disengaged from flange pin 9 of needle bar 7. During the disengagement of needle holder 11 from needle bar 7, compression spring 18 pushes locking bore 17 upwardly, whereby balls 16 are arrested in groove 24 and locking sleeve 13 is firmly retained in its uncoupling position.

After needle holder 11 has been disengaged from needle bar 7, magazine 84 is moved by air cylinder 82 away from needle bar 7. Further, switching bracket 108 is pivoted by air cylinder 111 downwardly, whereby all the thread catching levers 104 are pivoted up and thus lifted from stop plate 113. Only then magazine 84 is positioned through multiposition cylinder 59, and the selected needle holder 11 is brought into its starting position for coupling the needle bar 7.

Magazine 84 is displaced again in the direction of needle bars 7 by air cylinder 82, then lifted by air cylinder 77, and needle holder 11 is engaged on flange pin 9. At the same time, locking bolt 17 is pushed back by flange pin 9. Presser lever 95 resiliently applying against carrier 12 holds the carrier 12 and locking sleeve 13 in the uncoupled position even during the pushing back of locking bolt 17, and prevents thereby compression spring 26 through ring portion 22 from pushing balls 16 between locking bolt 17 and flange pin 9 into bolt 15. After needle holder 11 has completely been engaged on flange pin 9 and circular groove comes opposite the balls 16, magazine 84 is retracted by air cylinder 82. During the retraction, locking sleeve 13 is released fast, and pushed by compression spring 26 upwardly into its coupling position in which ring portion 22 pushes balls 16 into circular groove 10.

Simultaneously with the retraction of magazine 84 by air cylinder 82, air cylinder 34 moves locking lever 35 away from locking wheel 32, and air cylinder 111 lifts switching bracket 108, so that thread catching levers 104 pivot downwardly under their own weight. The thread catching levers 104 associated with needle threads which do not participate in the sewing operation then apply against sectors 115 and remain in the upper pivotal position shown in FIG. 2. Only the thread catching lever 104 associated with the needle thread participating in the following sewing operation drops into the corresponding slits 114 of stop plate 113 and comes out of the range of motion of take-up lever 8. Since the needles 28 of all the needle holders 11 are permanently provided with a thread and the threads are not unthreaded during an exchange of needle holders 11, the next sewing operation can start immediately after coupling a needle holder 11 to needle bar 7.

While specific embodiments of the invention have been shown and described in detail to illustrate the application of the principles of the invention, it will be understood that the invention may be embodied otherwise without departing from such principles.

What is claimed is:

1. A sewing machine equipped with a reciprocatable needle bar, a take-up lever engageable with the thread, and a thread changing mechanism, comprising a magazine, a plurality of needle holders received in said magazine, means mounting said magazine so that it is displaceable in the direction of its longitudinal axis and transversely to the reciprocation of the needle bar and vertically, said holders being separately and selectively couplable to the free end of said needle bar by a vertical relative motion between said magazine and the needle bar, said magazine having a plurality of sidewards open recesses for receiving respective ones of said needle holders and being movable in a horizontal plane crosswise to its longitudinal axis between the transfer position and a rest position, and also being movable vertically in order to effect the coupling and uncoupling operation.

2. A sewing machine according to claim 1, wherein said needle holders comprise a needle carrier which is provided with a receiving bore for the end of the needle bar and with a plurality of cross bores, and a ball radially movable in each of said cross bores, and a spring loaded, axially displaceable locking sleeve having an interior lock ring portion and an interior evasion opening for said balls and that the needle bar end is provided with a circular locking groove for said ball.

3. A sewing machine according to claim 2, including a spring loaded locking bolt, and wherein said carriers of said needle holders accommodate in the lower part of the receiving bore said spring loaded locking bolt which, during the uncoupling of the needle holders, moves axially upwardly thereby retaining the balls in the evasion opening and a presser lever on said magazine which resiliently apply against said carrier and are wedge shaped in the vertical plane.

4. A sewing machine according to claim 1, wherein at the upper side fo the magazine, laterally of the recesses, spring loaded clamping levers are provided which are pivotable about a vertical axis.

5. A sewing machine according to claim 1, including a take-up lever comprising a plurality of thread guiding fingers which are laterally spaced from each other and correspond in number to a number of needle holders, in opposite position, laterally of the paths of motion of the thread guiding fingers, an equal number of hook-shaped thread catching levers is associated with the takeup lever, which are individually movable between a catch position adjacent to the paths of motion of the associated thread guiding fingers, and a release position which is remote from the path of motion.

6. A sewing machine according to claim 5, wherein the thread catching levers are associated with a stop plate which is movable in synchronism with a magazine in the longitudinal direction thereof, and comprises a plurality of sectors which are separated from each other by vertical slits having a width adjusted to that of the thread catching levers, and by which the thread catching levers associated with the thread guiding fingers and not participating the stitch for the operation are held in catching position.

7. A sewing machine according to claim 1, wherein to stop the sewing machine exactly in the upper dead center position of the needle bar, a locking wheel is provided which is drivably connected to the arm shaft of the machine and provided with a wedge-shaped notch associated with a locking lever which is comformbly wedge-shaped and is actuable as soon as the switching machine is stopped.

8. A sewing machine comprising a reciprocating needle bar, a slide adjacent the sewing machine, mounting means mounting said slide for back and forth movement adjacent said needle bar, a magazine for a plurality of needle holders carried by said slide, vertical movement means carried by said slide and connected to said magazine for moving said magazine upwardly and downwardly relative to said slide into said needle bar, said magazine having a holding plate with a separate receiving recess for each needle holder arranged in a row along said plate in a direction of movement of said slide, slide moving means connected to said slide for shifting said slide with said magazine to position a selected needle holder in alignment with said needle bar, and a cross slide mounted on said slide for movement toward and away from said needle bar.

9. A sewing machine according to claim 8, including coupling means for coupling each of said needle holders to said needle bar.

10. A sewing machine according to claim 9, wherein said coupling means includes a pin formation on said needle bar terminating upwardly in an encircling flange of wider dimension that said pin, said needle holders being hollow and being of a size to receive said pin up to said flange, said needle holder having a coupling pin receiving ball with ball passage means therein, a locking ring slidably engaged on the exterior of said holder and having a plurality of radially extending ball receiving recesses around the periphery of the interior thereof, biasing means biasing said locking ring upwardly, a plurality of balls movable in the ball passage means and being retained in the groove of said pin by said locking ring and being disengageable from said pin when the ball receiving recesses are aligned with the balls.

11. A sewing machine according to claim 10, wherein said pin formation of said needle bar includes a lower end with an encircling groove therein to which said balls engage to lock said holder to said spindle bar and including a guard ring projecting from the exterior surface of said holder adjacent the top thereof agains which said locking ring is biased by said biasing means.

12. A sewing machine according to claim 8, including an arm shaft connected to said needle bar to move said needle bar upwardly and downwardly, a rotary hook drive shaft connected to said arm shaft for rotation thereby, a locking wheel carried by said rotary hook drive shaft and being rotatable therewith and having a lock notch thereon and a locking lever pivotally mounted adjacent said locking wheel and being movable to engage into said notch to lock said locking wheel and said drive when said needle bar is in its top dead center position.

13. A sewing machine according to claim 8, including a stop plate mounted on said slide adjacent said needle bar and having a plurality of alternately arranged needle support sectors and slots defined along a top face thereof, a guide finger for thread supply for each needle, a thread catching lever for each needle holder pivotally mounted adjacent said stop plate and said guide finger and being engageable at an operative position on a respective one of said sectors and with the thread fed to the operating needle from each thread supply and being in a non-operating position in a respective slot which aligns out of the path of movement of the associated needle thread.

14. A sewing machine according to claim 13, including a thread tightener comprising a support bolt, a pair of opposed discs positioned on said bolt, spring means biasing said discs rogether to engage a thread fed therebetween and hold it, and adjusting means for adjusting said spring biasing means, said thread supply including a thread for each needle holder passing between said disc.

15. A sewing machine according to claim 14, including a take-up lever movable with said needle bar to engage an operative thread and pivot it off the ply, and thread control means engageable with said thread catching lever to move all of them upwardly, said thread catching levers being positionable with said holders so that a holder which is aligned with said needle bar will have a thread catching lever which moves into the slits between sectors of said stop plate.

16. A sewing machine according to claim 14, including a take-up lever movable with said needle bar to engage an operative thread and pivot it off the ply, and thread control means engageable with said thread catching lever to move all of them upwardly, said thread catching levers being positionable with said holders so that a holder which is aligned with said needle bar will have a thread catching lever which moves into the slots between sectors of said stop plate, and a thread tightener comprising a support bolt, a pair of opposed discs positioned on said bolt, spring means biasing said disc together, and adjusting means on said bolt for adjusting said biasing means, said thread supply means including a thread for each needle holder passing between said disc.

* * * * *